US007772478B2

(12) United States Patent
Whitman et al.

(10) Patent No.: US 7,772,478 B2
(45) Date of Patent: Aug. 10, 2010

(54) UNDERSTANDING MUSIC

(75) Inventors: Brian A. Whitman, Somerville, MA (US); Barry Vercoe, Natick, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 11/734,740

(22) Filed: Apr. 12, 2007

(65) Prior Publication Data

US 2007/0240557 A1 Oct. 18, 2007

Related U.S. Application Data

(60) Provisional application No. 60/791,540, filed on Apr. 12, 2006.

(51) Int. Cl.
*A63H 5/00* (2006.01)

(52) U.S. Cl. ..... 84/609; 84/600; 84/603; 84/615; 84/616

(58) Field of Classification Search ..... 84/600, 84/603, 609, 615, 616
See application file for complete search history.

(56) References Cited

U.S. PATENT DOCUMENTS

| | | | | |
|---|---|---|---|---|
| 5,918,223 | A | 6/1999 | Blum et al. | |
| 6,539,395 | B1 | 3/2003 | Gjerdingen et al. | |
| 6,990,453 | B2 * | 1/2006 | Wang et al. | 704/270 |
| 7,013,301 | B2 | 3/2006 | Holm et al. | |
| 7,075,000 | B2 * | 7/2006 | Gang et al. | 84/600 |
| 7,081,579 | B2 * | 7/2006 | Alcalde et al. | 84/608 |
| 7,193,148 | B2 | 3/2007 | Cremer et al. | |
| 7,273,978 | B2 | 9/2007 | Uhle | |
| 7,277,766 | B1 | 10/2007 | Khan et al. | |
| 2003/0086341 | A1 * | 5/2003 | Wells et al. | 369/13.56 |
| 2004/0231498 | A1 * | 11/2004 | Li et al. | 84/634 |
| 2006/0065102 | A1 * | 3/2006 | Xu | 84/600 |
| 2006/0065105 | A1 * | 3/2006 | Iketani et al. | 84/609 |
| 2006/0096447 | A1 * | 5/2006 | Weare et al. | 84/616 |
| 2006/0130637 | A1 * | 6/2006 | Crebouw | 84/603 |
| 2007/0131094 | A1 * | 6/2007 | Kemp | 84/609 |

OTHER PUBLICATIONS

Sounds Good?, The Economist Technology Quarterly, Jun. 10, 2006, available at http://www.uplaya.com/news/2006/The%20Economist%20Technology%20Quarterly%20(Jun.%2010,%202006).pdf.

(Continued)

*Primary Examiner*—Walter Benson
*Assistant Examiner*—Kawing Chan
(74) *Attorney, Agent, or Firm*—SoCal IP Law Group LLP; Steven C. Sereboff; John E. Gunther

(57) ABSTRACT

There are disclosed methods and apparatus for understanding music. A classifier machine may be trained for each of a plurality of selected terms using a first plurality of music samples. The classifier machines may then be tested using a second plurality of music samples. The results from testing the classifier machines may then be used to select a plurality of semantic basis function from the selected terms. A semantic basis classifier machine may then be trained for each semantic basis function.

23 Claims, 8 Drawing Sheets

OTHER PUBLICATIONS

Ellis, Daniel P.W., et al. The Quest for Ground Truth in Musical Artist Similarity, Proceedings of IRCAM (Instutite for Music/Acoustic Research and Coordination), 2002, Centre Pompidou, Paris France.

Berenzweig, Adam et al., A Large-Scale Evaluation of Acoustic and Subjective Music Similarity Measures, Proceedings of ISMIR (International Conference on Music Information Retrieval), 2003, Johns Hopkins University, Baltimore, MD.

Cano, Pedro et al., A Review of Algorithms for Audio Fingerprinting, International Workshop on Multimedia Signal Processing, Dec. 9-11, 2002, US Virgin Islands.

Recht, Ben and Whitman, Brian, Musically Expressive Sound Textures fro Generalized Audio, Proc. of the 6th Int. Conference on Digital Audio Effects (DAFx-03), Sep. 8-11, 2003, London, UK.

Rifkin, Ryan, et al. Regularized Least-Squares Classification, CBCL Paper #268/AI Technical Report #2007-019, Massachusetts Institute of Technology, 2007, Cambridge, MA.

Whitman, Brian and Smaragdis, Paris, Combining Musical and Cultural Features for Intelligent Style Detection, Proc. Int. Symposium on Music Inform. Retriev. (ISMIR) 2002, pp. 47-52.

Whitman, Brian and Lawrence, Steve, Inferring Descriptions and Similarity for Music from Community Metadata, Proceedings of the 2002 International Computer Music Conference, Gothenburg, Sweden.

Whitman, Brian and Rifkin, Ryan, Musical Query-by-Description as a Multiclass Learning Problem, 2002 IEEE Workshop on Multimedia Signal Processing, Dec. 9-11, 2002, pp. 156-156.

Whitman, Brian, et al. Learning Word Meanings and Descriptive Parameter Spaces from Music, Proceedings of the HLT-NAACL (Human Language Technology Conference) 2003 Workshop on Learning Word Meaning From Non-Linguistic Data, vol. 6, pp. 92-99.

Whitman, Brian, Semantic Rank Reduction of Music Audio, Proceedings of 2003 IEEE Workshop on Appplicatins of Signal Processing to Audio and Acoustics, Oct. 19-22, 2003, New Peltz, NY.

Whitman, Brian, and Ellis, Daniel P.W., Automatic Record Reviews, Proceedings of the 2004 International Symposium on Music Information Retrieval at Universitat Pompeu Fabra, Barcelona, Spain.

* cited by examiner

UNDERSTANDING MUSIC

RELATED APPLICATION INFORMATION

This application claims benefit of the filing date of provisional patent application Ser. No. 60/791,540, filed Apr. 12, 2006, which is incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to understanding and retrieving music.

2. Description of the Related Art

Currently, the field of music retrieval has followed the methods used for text retrieval including semantic tagging and organization techniques. Characters became samples, words became frames, documents became songs. Currently, music may be expressed as a feature vector of signal-derived statistics, which may approximate the ear, as in machine listening approaches. Alternately, music may be expressed by the collective reaction to the music in terms of sales data, shared collections, or lists of favorite songs. The signal-derived approaches may predict, with some accuracy, the genre or style of a piece of music, or compute acoustic similarity, or detect what instruments are being used in which key, or discern the high-level structure of music to tease apart verse from chorus.

It is believed that current systems for retrieving music ignore the "meaning" of music, where "meaning" may be defined as what happens in between the music and the reaction. It is believed that current systems do not have the capability to learn how songs make people feel, and current systems do not understand why some artists are currently selling millions of records, and other artists are not. It is believed that current retrieval systems are stuck inside a perceptual box—only being able to feel the vibrations without truly understanding the effect of music or its cause.

DETAILED DESCRIPTION

Throughout this description, the embodiments and examples shown should be considered as exemplars, rather than limitations on the apparatus and methods disclosed or claimed.

Throughout this description, mathematical formula will follow normal American typographical conventions. An italic font will be used for all letters representing variables, except for upper case Greek letters, which are in an upright font. Bold upper case letters represent matrices, and bold lower case letters represent vectors. Elements within matrices and vectors are represented by the corresponding non-bold letter. Thus Q represents a matrix, and Q(i,j) represents an element with the matrix Q. Similarly x represents a vector, and x(i) represents an element with vector x.

Description of Methods

Figure 1:
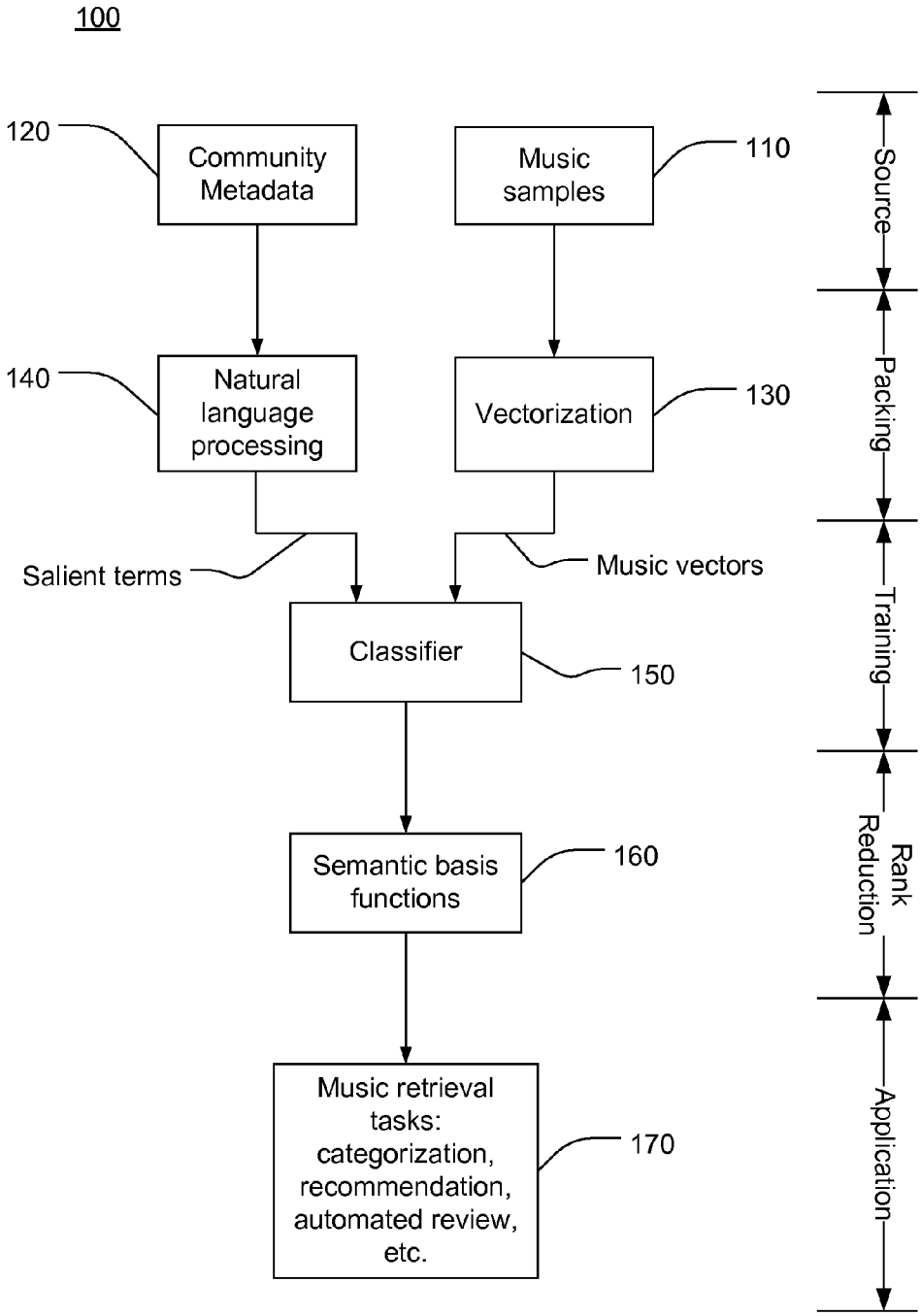
FIG. 1 is a flow chart of a method for understanding music.

Refer now to FIG. 1, which shows a flow chart of a method 100 for understanding music. Through the method 100, the relationship between the content of the audio signal that constitutes the music and the collective interpretation of the music by the community of listeners may be learned. According to the method 100, the learned understanding of music may be applied to music retrieval tasks that may include categorization of new music samples, recommendation of music based on listener-provided criteria, automated review of new music samples, and other related tasks.

A plurality of music samples may be selected (110). Each music sample may be all or a portion of a song or track. Each music sample may be a compilation of samples of different tracks, songs, or portions of a work, or a compilation of samples of work by the same group, artist, or composer. Each music sample may be converted into vector form (130). Within this application, the vector representation of each music sample will be referred to as a "music vector". It must be understood that a "music vector" is not music in any conventional sense of the word, but is a numerical representation of the content of a music sample. The vectorization process 130, which may be any of a number of known processes, may attempt to pack the content of the corresponding music sample into the minimum number of elements possible while still retaining the essential features of the music necessary for understanding.

At 120, community metadata relating to the plurality of music samples may be retrieved. As used herein, "metadata" means text-based data relating to music, and "community metadata" is text-based data generated by the community of music listeners. Community metadata may be retrieved from the Internet or other sources. At 140, natural language processing techniques may be applied to the community metadata retrieved in step 120 to select salient terms. As used herein, "salient terms" are words or phrases relating to music that stand out from the mass of words comprising the community metadata. Methods for selecting salient terms will be described in detail subsequently.

At 150, a classifier may be trained to relate the salient terms selected at 140 to the content of the music vectors developed in 130. In general use, a "classifier" is an algorithm, which may be used with one or more supporting data structures, to determine if a data sample falls within one or more classes. As used herein, a "classifier" means an algorithm, which may be used with one or more data structures, to determine if a music sample is likely to be described by one or more salient terms selected from the community metadata. As used herein, a "classifier machine" is a vector, matrix, or other data structure that, when applied to a music sample by means of a related classifier algorithm, indicates if the music sample is likely to be described by a particular salient term. The classifier training 150 may include applying an algorithm to a plurality of music samples and a plurality of salient terms where the relationship (i.e. which terms have been used to describe which music samples) between the samples and terms is known. The result of the training of the classifier 150 may be a set of classifier machines that can be applied to determine which terms are appropriate to describe new music samples.

After training the classifier 150, the number of classes, or ranks, may be reduced by selecting semantic basis functions from the plurality of salient terms. As used herein, a "semantic basis function" is a word, group of words, or phrase that has been shown to be particularly useful or accurate for classifying music samples. The semantic basis functions, and classifier machines related to the semantic basis functions, may be used at 170 for music retrieval tasks that may include categorization of new music samples, recommendation of music based on listener-provided criteria, automated review of new music samples, and other related tasks.

Figure 2:
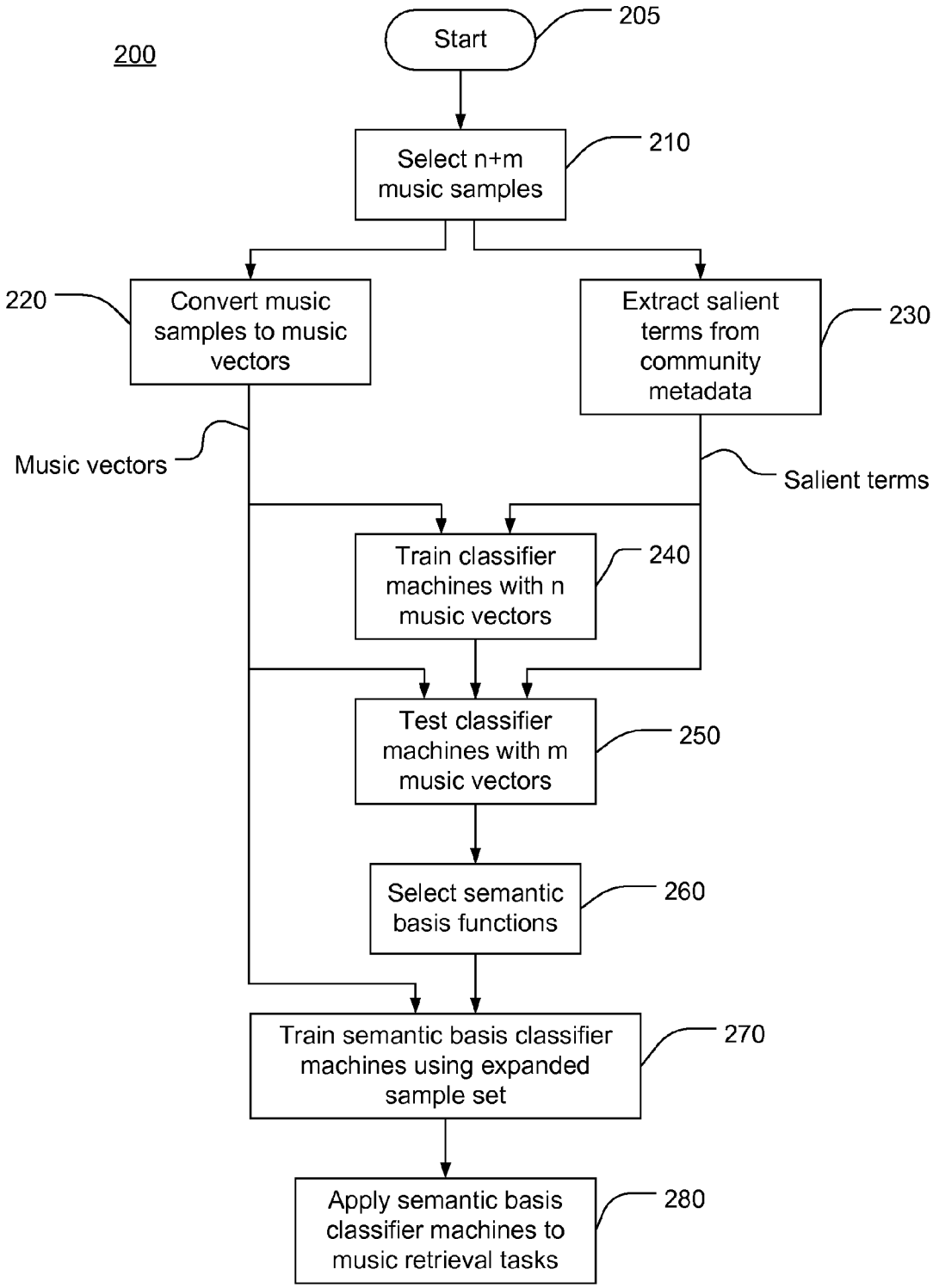
FIG. 2 is a flow chart of a method for understanding music.

FIG. 2 is a flow chart of a method 200 for understanding music which is an expansion of the method 100 shown in FIG. 1. Starting at 205, a first plurality of n music samples and a second plurality of m music samples may be selected (210). At 220, the first and second pluralities of music samples may be converted to corresponding pluralities of music vectors. At 230, a plurality of salient terms relevant to the first and second pluralities of music samples may be extracted from the community metadata. Details of the methods for converting music samples to music vectors and for extracting salient terms will be discussed subsequently.

At 240, a plurality of classifier machines may be trained using the first plurality of n music samples. Each of the plurality of classifier machines may relate to a corresponding one of the plurality of salient terms extracted at 230.

At 250, the plurality of classifier machines may be tested using the second plurality of m music vectors as test vectors. Testing the plurality of classifier machines may consist of applying each classifier machine to each test vector to predict what salient terms may be used to describe which test vector. These predictions may then be compared with the known set of terms describing the second plurality of music sample that were extracted from the community metadata at 230. The comparison of the predicted and known results may be converted to an accuracy metric for each salient term. The accuracy metric may be the probability that a salient term will be predicted correctly or other metric for each salient term.

At 260, a plurality of semantic basis functions may be selected from the plurality of salient terms. The semantic basis functions may be selected based on the accuracy metric for each salient term. A predetermined number of salient terms having the highest accuracy metrics may be selected for the semantic basis functions. The semantic basis functions may be all salient terms having an accuracy metric higher than predetermined threshold. Other criteria may be used to select the semantic basis functions. For example, a filter may be applied to candidate semantic basis functions to minimize or eliminate redundant semantic basis functions having similar or identical meanings.

Having selected semantic basis functions, a set of semantic basis classifier machines may be computed 270. The method used to compute the semantic basis classifier machines may be the same as the method initially used to train classifier machines at 240. The set of music samples used to train semantic basis classifier machines at 270 may be larger than the first plurality of music samples. The set of music samples used to train semantic basis classifier machines at 270 may include all or part of the first plurality of music samples, all or part of the second plurality of music samples, and/or additional music samples.

The semantic basis classifier machines trained at 270 may be used at 280 for music retrieval tasks that may include categorization of new music samples, recommendation of music based on listener-provided criteria, automated review of new music samples, and other related tasks. Note that the method 200 has a start at 205, but does not have an end since 280 may be repeated indefinitely. Additionally, note that the method 200 may be repeated in whole or in part periodically to ensure that the semantic basis functions and semantic basis classifier engines reflect current musical styles and preferences.

A number of methods are known for 220 wherein music samples are converted to music vectors or other numerical representation. These methods may use time-domain analysis, frequency-domain analysis, cepstral analysis, or combinations of these methods.

A simple and popular method is colloquially known as a "beatogram"; or more formally as a spectral autocorrelation. A digitized music sample is divided into a series of short time windows, and a Fourier transform is performed on each time window. The result of each Fourier transform is the power spectrum of the music signal divided into a plurality of frequency bins. A single FFT is then applied to the time history of each frequency bin. The intuition behind the beatogram is to capture both the frequency content and time variation of the frequency content of music samples.

Cepstral analysis was derived from speech research. Cepstral analysis is computationally cheap, well studied, and a known method for music representations (see, for example, B. Logan, "Mel frequency cepstral coefficients for music modeling," *Proceedings of the International Symposium on Music Information Retrieval*, Oct. 23-25, 2000). Mel-frequency cepstral coefficients (MFCCs) are defined as the mel-scaled cepstrum (the inverse fourier transform of the logarithm of the power spectrum on a mel scale axis) of the time-domain signal. The mel scale is a known non-linear pitch scale developed from a listener study of pitch perception. MFCCs are widely used in speech recognizers and other speech systems as they are an efficiently computable way of reducing the dimensionality of spectra while performing a psychoacoustic scaling of frequency response.

Another method for converting music samples into music vectors at 220 may be may be Modulation Cepstra (see B. Whitman and D. Ellis, "Automatic Record Reviews," *Proceedings of the* 2004 *International Symposium on Music Information Retrieval,* 2004. Modulation Cepstra may be considered as a cepstral analog to the previously described "beatogram".

Figure 3:
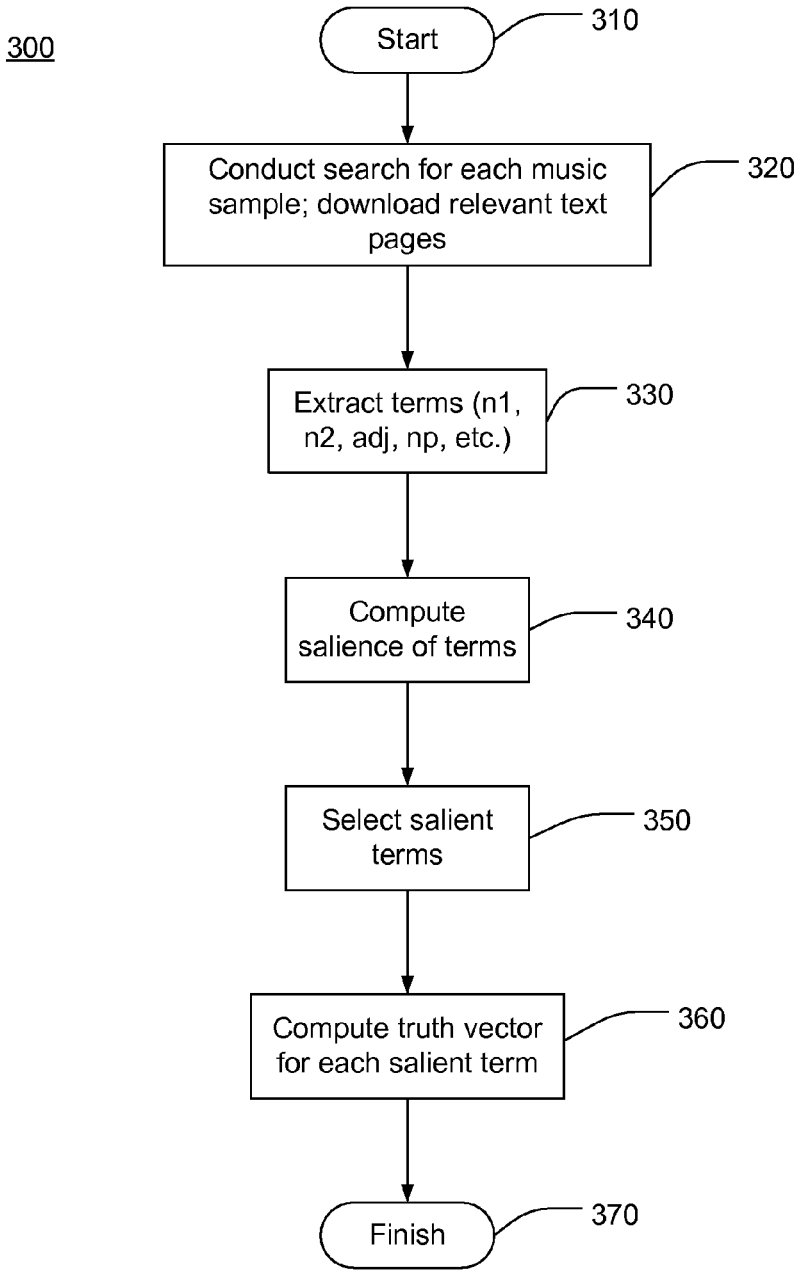
FIG. 3 is a flow chart of a method for selecting salient terms.

FIG. 3 is a flow chart of a method 300 to select salient terms. The method 300 may be appropriate for 140 of method 100 and 230 of method 200. Starting at 310, a search is performed at 320 for textual information relating to each music sample that will be used to train or test a classifier. The search may be performed over a variety of data bases containing text information about artists, albums, and songs. Such data bases may include a client's repository of user-submitted record reviews, a web application that allows user to talk about music in a chat room scenario, the Web as a whole, or other sources of searchable information about music. The search criteria may be the title of the music sample where the music sample is a song or track. Other search criteria may be used such as a name of a performer or group, or an album title. The search criteria may be augmented with key words such as "music" or "review" to limit the number and ensure the relevance of search hits. A plurality of text pages may be downloaded for each music sample.

At 330, language processing techniques may be employed to extract terms from the downloaded text pages. The extracted terms may include n-grams (sequences of ordered words having n words) such as single words (n1) and two-word groups (n2). The extracted terms may also include adjectives (adj) and noun phrases (np). Known methods are available to extract these and other terms from the downloaded pages (see, for example, E. Brill, "A simple rule-based part-of-speech tagger," *Proceedings of the 3rd Conference on Applied Natural Language Processing,* 1992, and L. Ramshaw and M. Marcus, "Text chunking using transformation-based learning," *Proceedings of the 3rd Workshop on Very Large Corpora,* 1995).

At 340, the salience of each term may be computed. The salience of each term is an estimation of the usefulness of the term for understanding music samples. The salience of a term is very different from the occurrence of the term. For example, the word "the" is likely to be used in every downloaded document, but carries no information relevant to any music sample. At the other extreme, a word that appears only once in all of the downloaded Web pages is quite probably misspelled and equally irrelevant.

At 340, the salience of each term may be computed as the well-known Term Frequency-Inverse Document Frequency (TF-IDF) metric, which is given by:

$$s(t\ M) = \frac{P(t\ M)}{P(t\ M^{\infty})}$$

where s(t|M) is the salience of term t with respect to context (music sample) M; P(t|M) is the probability that a downloaded document within the document set for music sample M contains term t; and $P(t|M^{\infty})$ is the probability that any document of the documents downloaded for all music samples contains term t. The effect of the TF-IDF metric is to reduce, or down-weight, the salience of very common or infrequently used words.

To further down-weight very rare words, such as typographic errors and off-topic words, a Gaussian-like smoothing function may be used to compute salience:

$$s(t|M)=P(t|M)e^{-(\log(P(t|M^{\infty}))-\mu)^2}$$

where P (t|M∞) is normalized such that its maximum is equal to the total number of documents, and μ is a constant selected empirically. Other methods may be used to compute salience. The salience may be computed for each extracted term with respect to each of the plurality of music samples.

At 350, a plurality of salient terms may be selected. The selected salient terms may be those terms having a salience exceeding a threshold value for at least one music sample or for at least a predetermined number of music samples. The selection of salient terms may also consider possible overlap or redundancy of terms having similar meaning. For example, the well known Latent Semantic Analysis may be used to cluster terms into many similar meaning groups, such that only the highest salience terms may be selected from each group. Note that 350 is optional and the subsequent processes may proceed using all terms.

At 360, a truth vector $y_t$ may be constructed for each salient term selected in 350. A truth vector $y_t$ is an l-element vector, where l is the number of music samples in a sample set. Each element $y_t(M)$ in the truth vector $y_t$ indicates if term t is salient to music sample M. Each element $y_t(M)$ in the truth vector $y_t$ may be equal to the salience s(t|M), scaled to span the range from −1 to +1. Alternately, a threshold may be applied such that a salience value above the threshold is set to +1, and a salience value below the threshold is set to −1. In this case, each element $y_t(M)$ in the truth vector $y_t$ may be either −1 or +1. A value of −1 may indicate that term t is not salient to music sample M, and a value of +1 may indicate the converse.

While the method 300 has a start at 310 and a finish at 370, it should be understood that the method is at least partially recursive and that step 340 must be performed for every combination of music sample M and term t.

Various machine classification methods, including Support Vector Machines and Regularized Least Squares Classifiers (RLSC) may be used for music understanding. An RLSC is well suited to music understanding since the RLSC can be readily extended to large number of classes. In the music understanding methods 100 and 200, each salient term represents a class, where the class definition is "music samples that can be appropriately described by this term". Details of the RLSC method are well known (see, for example, Rifkin, Yeo, and Poggio, "Regularized Least Squares Classification," *Advances in Learning Theory: Methods, Models, and Applications, NATO Science Series III: Computer and Systems Science*, Vol. 190, 2003).

Figure 4:
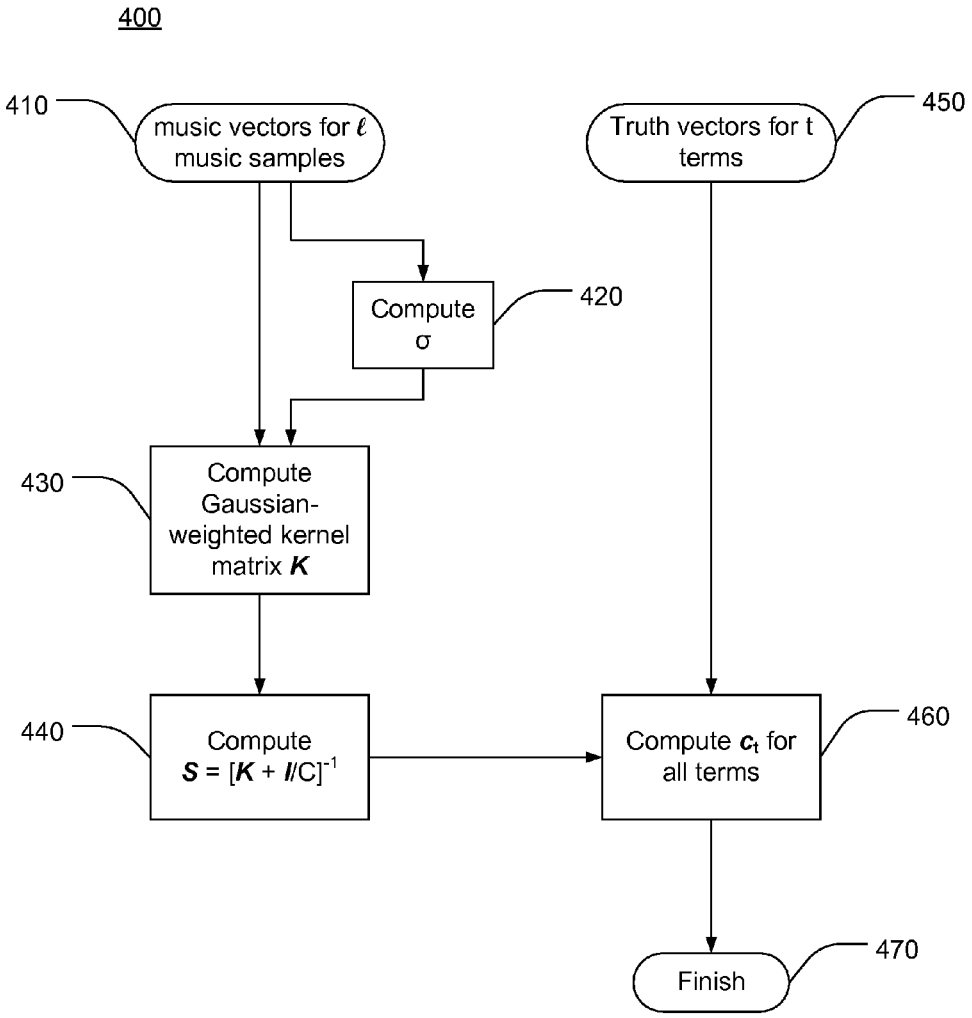
FIG. 4 is a flow chart of a method for trainer a classifier machine.

FIG. 4 is a flow chart of a method 400 for training an RLSC. The method 400 may be appropriate for 240 and 270 of the method 200 as shown in FIG. 2. The method 400 begins at 410 with l music vectors, each of which represents a music sample. The l music vectors may be provided by the method 300 of FIG. 3, or another method.

At 430, a Gaussian-weighted kernel matrix K is computed from the l music vectors. K is an l×l matrix where each element is given by $$K(i,j)=e^{-(|x-x|)^2/\sigma^2}$$

where $|x_i-x^j|$ is the Euclidean distance between music vector $x_i$ and music vector $x_j$, and σ is a standard deviation. The l music vectors may be normalized, in which case u may be defined to equal 0.5. The l music vectors may not be normalized, in which case U may be determined empirically.

Optionally, when the l music vectors are not normalized, u may be determined at 420 by $$\sigma \approx \sqrt{\max_{i\in d\ \ j\in l}(A_{ij})}$$

where $A_{ij}$ is a matrix containing the l music vectors, each of which has d dimensions or elements. In this case, σ is the square root of the largest element in any of the l music vectors.

At 440, a "support matrix" S is computed. The term support matrix is used herein since matrix S is analogous to the support vectors produced by a support vector machine. The calculation of matrix S proceeds through two steps. First, a regularization term I/C is added to the kernel matrix K to form a sum matrix, where I is the identity matrix and C is a constant. C may be initially set to 100 and tuned empirically to the input music vectors. The sum matrix is then inverted to form the support matrix, which is given by $$S = \left[K + \frac{I}{C}\right]^{-1}$$

The inversion may be done by a conventional method, such as Gaussian elimination, which may be preceded by a factorization process such as the well-known Cholesky decomposition.

At 450, the method 400 may receive a plurality of t truth vectors, $y_t$, for t salient terms. The truth vectors may be provided by the method 300 of FIG. 3 or another method. At 460, a classifier machine vector $C_t$ may be calculated for each for each truth vector, as follows $$c_t = Sy_t$$

where S is the support matrix and $c_t$ and $y_t$ are the classifier machine and truth vector, respectively, for salient term t.

Figure 5:
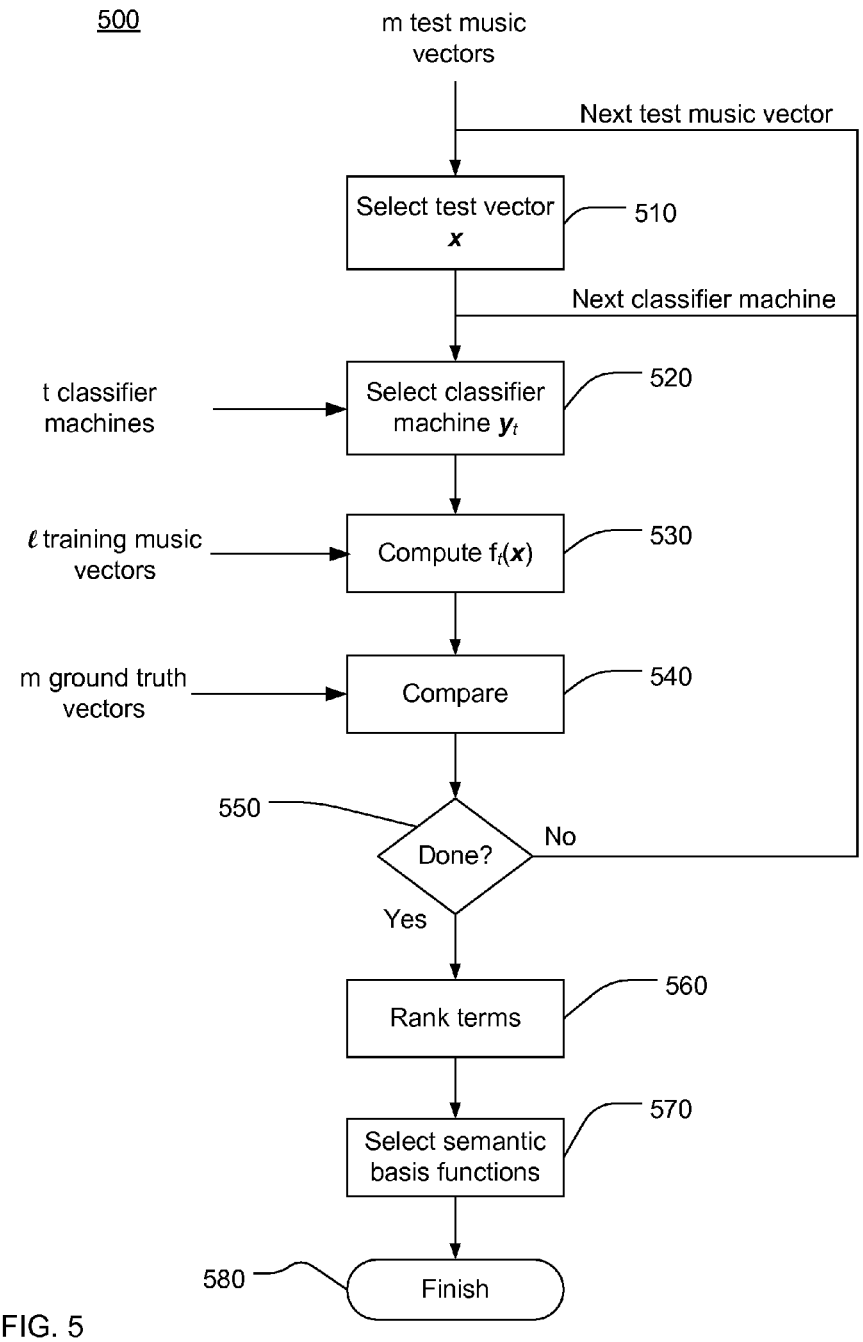
FIG. 5 is a flow chart of a method to test a classifier.

FIG. 5 is a flow chart of a method 500 that may be used to test a classifier after the classifier has been trained using the method 600 or another method. The input to the method 500 may be a set of m test music vectors. Each test music vector may have a corresponding ground truth vector indicating which of t terms are salient to the music sample represented by the music vector.

At 510, one of the m test music vectors may be selected and, at 520, one of t classifier machines may be selected. At 530, a function $f_t(x)$ may be computed as follows $$f_t(x) = \sum_{i=1}^{l} C_t(i)K(x, x_i)$$

where x is the test music vector, $x_i$ is one of the l music vectors used to train the classifier, and $c_t(i)$ is the i'th term of classifier engine $c_t$ for term t. $f_t(x)$ is a scalar value that may be considered as the probability that term twill be used to describe the music sample represented by music vector X.

At step 540, $f_t(x)$ is compared with the corresponding value within the ground truth vector corresponding to x. $f_t(x)$ may be considered to be correctly predicted if the numerical sign of $f_t(x)$ is the same as the sign of the corresponding term in the ground truth vector. Other criteria may be used to define if $f_t(x)$ has been correctly predicted.

At step 550, a decision is made if all combinations of test music vectors and classifier machines have been evaluated. If not, steps 520-540 may be repeated recursively until all combinations are evaluated. A score for each classifier machine may be accumulated during the recursive process. After all combinations of test music vectors and classifier machines have been evaluated, the classifier machines and the associated salient terms may be ranked in step 560 and semantic basis functions may be selected from the higher ranking salient terms in step 570.

Figure 6:
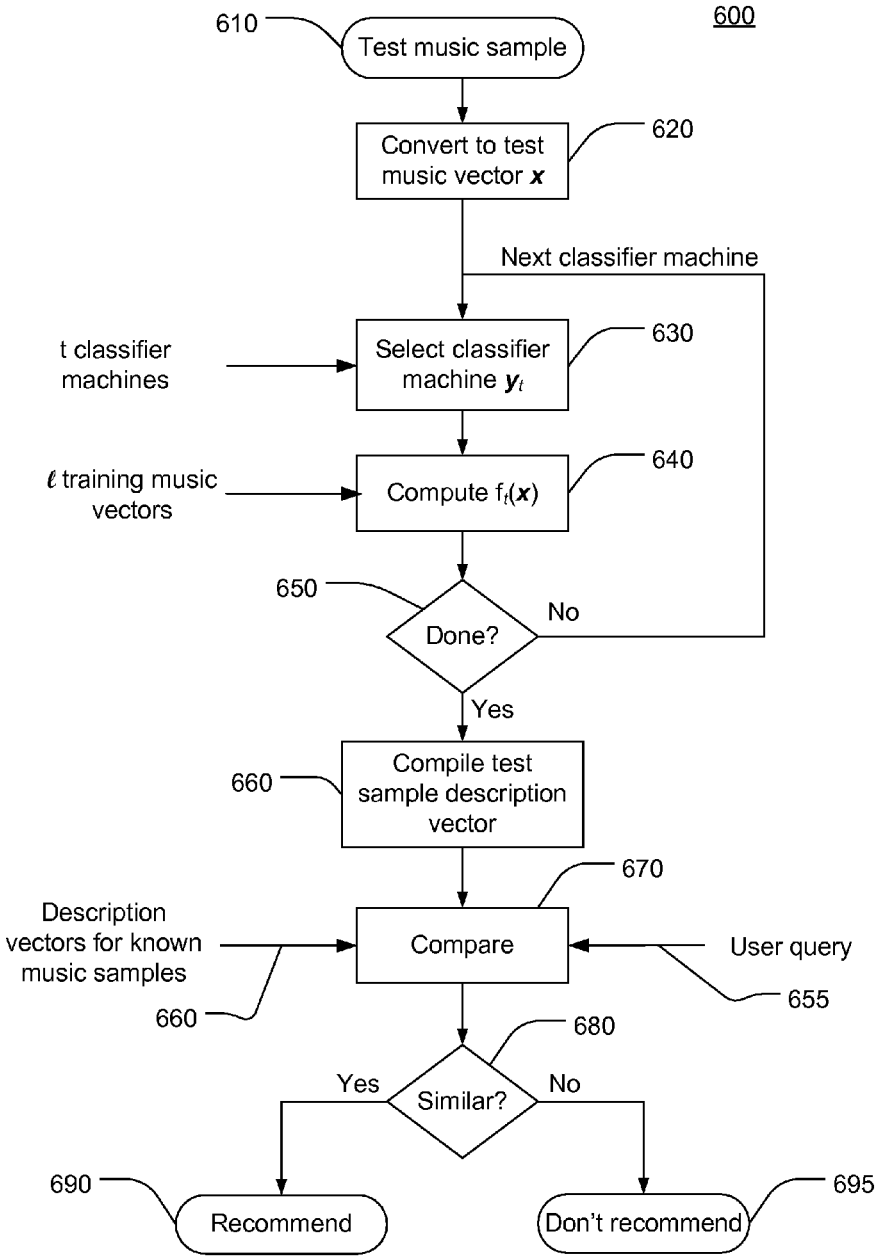
FIG. 6 is a flow chart of a method to use semantic basis functions to recommend music.

FIG. 6 is an exemplary process 600 for evaluating a test music sample selected at 610. The test music sample may be a new sample not contained in the plurality of music samples used to train the classifier machines. The test music sample may be an existing music sample selected for further evaluation. At 620, the test music sample may be converted to a test music vector x. At 630, the first of t classifier machines may be selected. At 640, the function $f_t(x)$ may be computed, as previously described, using a set of l music vectors used to train the classifier machines. At 650, a decision may be made if the test music vector has been evaluated with all t classifier machines. If not, 630-640 may be repeated recursively until all combinations are evaluated.

At 660, the results of the previous steps may be combined to form a test sample description vector f(x) for the new music sample, as follows $$f(x) = \begin{bmatrix} f_1(x) \\ \vdots \\ f_t(x) \end{bmatrix}.$$

The test sample description vector f(x) may be a powerful tool for understanding the similarities and differences between music samples.

For example, at 670 the test sample description vector f(x) may be compared with a descriptive query 675 received from a user. This query may take the form of one or more text expressions, such as "sad", "soft" or "fast". The query may be entered in free-form text. The query may be entered by selecting phrases from a menu, which may include or be limited to a set of predetermined semantic basis functions. The query may be entered by some other method or in some other format. The query may be converted into an ideal description vector to facilitate comparison. The comparison of the test sample description vector f(x) and the query may be made on an element-by-element basis, or may be made by calculating a Euclidean distance between the test sample description vector f(x) and the ideal description vector representing the query.

At 680, a determination may be made if the test music sample satisfies the query. The test music sample may be considered to satisfy the query if the Euclidean distance between the test sample description vector f(x) and the ideal description vector representing the query is below a predetermined threshold. The test music sample may be recommend to the user at 690 if the test music sample is sufficiently similar to the query, or may not be recommended at 695.

Alternatively, at 670, the test sample description vector f(x) may be compared with description vectors for one or more known target music samples 677. For example, a user may request a play list of music that is similar to one or more target music samples 677. In this case, a test music sample may be recommended to the user if the Euclidean distance between the test sample description vector and the description vectors of the target music samples are below a predetermined threshold.

Song recommendation, as described above, is a one example of the application of the method for understanding music. Other applications include song clustering (locating songs similar to a test sample song or determining if a test sample song is similar to a target set of songs), genre and style prediction, marketing classification, sales prediction, or fingerprinting (determining if a song with different audio characteristics "sounds like" a copy of itself).

Training the classifier over a large number of songs will result in very large kernel and support matrices. For example, training the classifier over 50,000 songs or music samples may require a 50,000×50,000-element kernel matrix. Such a large matrix may be impractical to store or to invert to form the equally-large support matrix.

Figure 7:
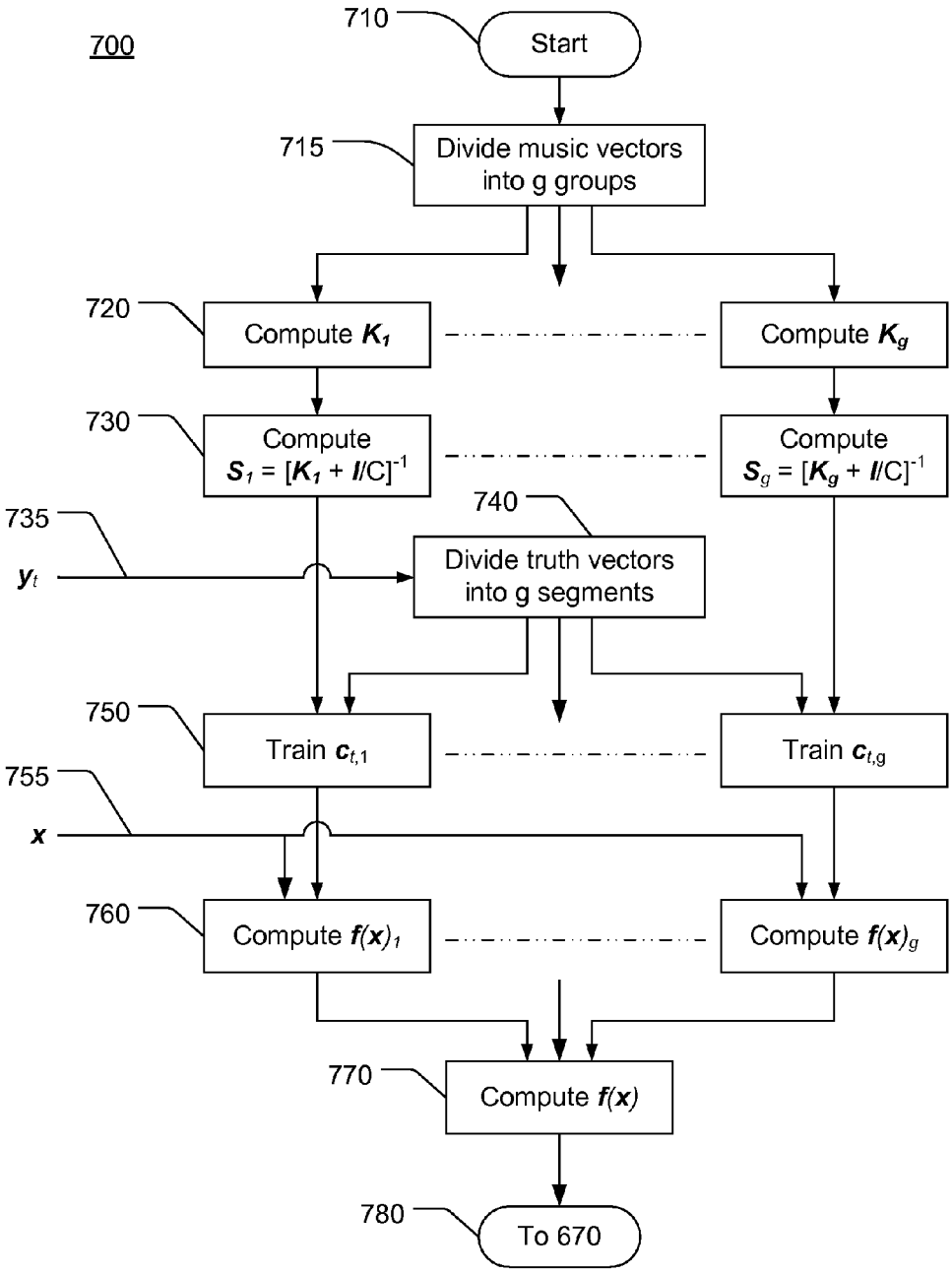
FIG. 7 is a flow chart of a method for understanding music.

FIG. 7 is a flow chart of a method 700 that partitions the classifier training problem. The method 700 starts with the receipt of l music vectors at 710. At 715, the l music vectors are randomly ordered and divided into g groups, each group having l/g music vectors. The number of groups may be selected such that the kernel matrix for l/g music vectors can be stored and processed in a single computing device such as a server or personal computer. In this manner, classifier training may be performed by g computing devices operating in parallel.

At 720, a kernel sub-matrix $K_i$ is calculated for each group of music vectors. At 730, a support sub-matrix $S_i$ is calculated from each of the kernel matrices. At 735, t truth vectors, $y_t$, corresponding to t terms (or t semantic basis functions) are introduced. At 740 each truth vector may be divided into g segments. Note that the elements of the truth vectors must be reordered to match the order of the music samples prior to segmentation. At 750, sub-classifier machines are trained for each group of music samples. Sub-classifier machine $c_{t,1}$ is a classifier machine for term t trained on music vector group 1. A total of t×g sub-classifier machines are trained, each having l/g elements. The computational methods for forming the kernel sub-matrices, support sub-matrices, and sub-classifier machines may be essentially the same as described for 420-460 of method 400 shown in FIG. 4.

At 760, each group of t sub-classifier machines may be used to compute a sub-description vector $f(x)_i$ for a test music vector x introduced at 755. $f(x)_i$ is a sub-description vector for test music vector x formed by a sub-classifier trained on music vector group i. A total of g sub-description vectors may be computed at 760. The computational methods used in 760 may be essentially the same as 630-660 of method 600 of FIG. 6.

At 770, a final test sample description vector f(x) may be computed by combining the g sub-description vectors $f(x)_i$ from 760. The final test sample description vector f(x) may be computed by averaging the $f(x)_i$ from 760, or by some other method. At 780, the final test sample description vector f(x) may be input to music retrieval tasks such as 670 in FIG. 6.

Description of Apparatus

Figure 8:
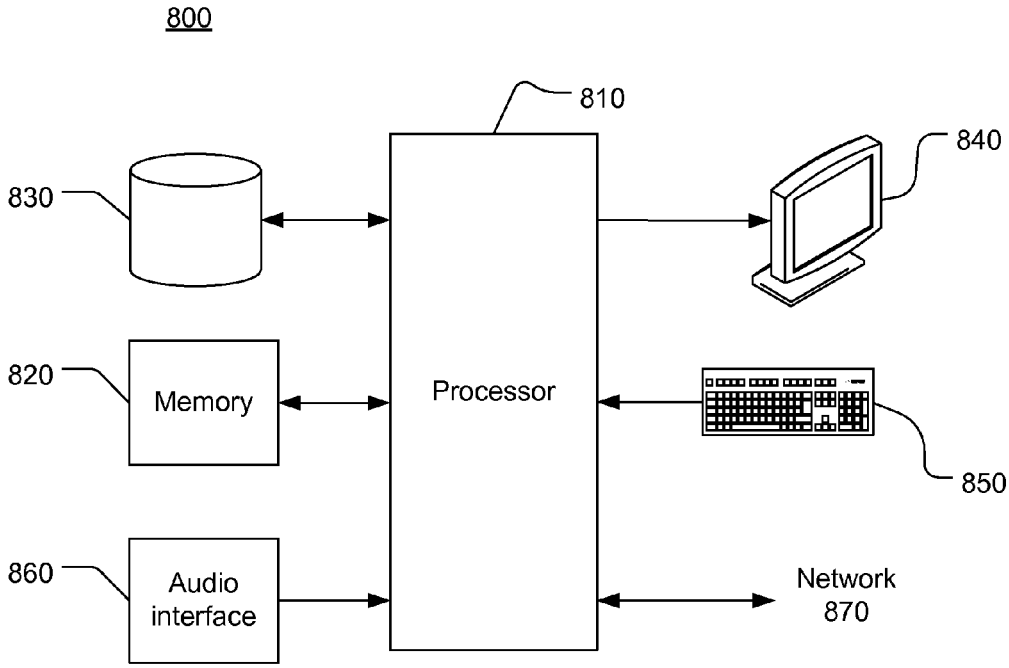
FIG. 8 is a block diagram of a computing device.

FIG. 8 is a block diagram of a computing device 800 that may be suitable for executing the previously described methods. A computing device as used herein refers to any device with a processor 810, memory 820 and a storage device 830 that may execute instructions including, but not limited to, personal computers, server computers, computing tablets, set top boxes, video game systems, personal video recorders, telephones, personal digital assistants (PDAs), portable computers, and laptop computers. These computing devices may run an operating system, including, for example, variations of the Linux, Unix, MS-DOS, Microsoft Windows, Palm OS, Solaris, Symbian, and Apple Mac OS X operating systems.

The computing device 800 may include or interface with a display device 840 and input device 850. The computing device 800 may also include an audio interface unit 860 which may include an analog to digital converter. The computing device 800 may also interface with one or more networks 870.

The storage device 830 may accept a storage media containing instructions that, when executed, cause the computing device 800 to perform music understanding methods such as the methods 100 to 700 of FIG. 1 to FIG. 7. These storage media include, for example, magnetic media such as hard disks, floppy disks and tape; optical media such as compact disks (CD-ROM and CD-RW) and digital versatile disks (DVD and DVD±RW); flash memory cards; and other storage media. As used herein, a storage device is a device that allows for reading and/or writing to a storage medium. Storage devices include hard disk drives, DVD drives, flash memory devices, and others.

Closing Comments

The foregoing is merely illustrative and not limiting, having been presented by way of example only. Although examples have been shown and described, it will be apparent to those having ordinary skill in the art that changes, modifications, and/or alterations may be made.

Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, and to mean "including but not limited to". Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A method for understanding music, comprising training a plurality of classifier machines using a first plurality of music samples, each classifier machine trained for a corresponding one of a plurality of terms testing the plurality of classifier machines using a second plurality of music samples using the results of testing the classifier machines to select a plurality of semantic basis functions from the plurality of terms training a set of semantic basis classifier machines, wherein each semantic basis classifier machine is trained for a corresponding one of the selected semantic basis functions each semantic basis classifier machine is trained with a third plurality of music samples larger than the first plurality of music samples training the set of semantic basis classifier machines further comprises:

dividing the third plurality of music samples into g groups, where g is an integer greater than one training g sets of semantic basis sub-classifier machines, each set of semantic basis sub-classifier machines trained using a corresponding group of the g groups of music vectors.

2. The method for understanding music of claim 1, further comprising selecting a test music sample using the semantic basis sub-classifier machines to compute sub-description vectors for the test music sample forming a test sample description vector for the test music sample by combining the sub-description vectors.

3. The method for understanding music of claim 2, further comprising comparing the test sample description vector with a description provided by a user recommending or not recommending the test music sample to the user depending on the results of the comparison.

4. The method for understanding music of claim 2, further comprising comparing the test sample description vector with one or more description vectors for target music samples determining the test music sample to be similar or not similar to the target music samples depending on the results of the comparison.

5. The method for understanding music of claim 2, further comprising predicting sales, style, genre, or marketing classification from the test sample description vector.

6. A method for understanding music, comprising converting a first plurality of music samples and a second plurality of music samples into a first plurality of music vectors and a second plurality of music vectors, respectively extracting a plurality of salient terms relevant to the first plurality and second plurality of music samples training a plurality of classifier machines using the first plurality of music vectors, each classifier machine trained for a corresponding one of the plurality of salient terms testing the classifier machines using the second plurality of music vectors using the results of testing the classifier machines to select semantic basis functions from the plurality of salient terms training a semantic basis classifier machine for each of the selected semantic basis functions, each semantic basis classifier machine trained using a third plurality of music vectors larger than the first plurality of music vectors, wherein training each semantic basis classifier further comprises randomly distributing the third plurality of music vectors into two or more groups of music vectors computing a support sub-matrix from each group of music vectors, computing a support sub-matrix comprising computing a Gaussian-weighted kernel matrix from the group of music vectors adding a regularization term to provide a sum matrix inverting the sum matrix to provide the support sub-matrix computing sub-classifier machines from the support sub-matrices for each of the selected semantic basis functions applying the semantic basis classifier machines to a test music sample to compute a test sample description vector for the test music sample.

7. The method for understanding music of claim 6, comprising recommending the test music sample to at least one user based on a comparison of the test sample description vector with a user-supplied description.

8. The method for understanding music of claim 6, comprising determining the test music sample to be similar or not similar to one or more target music samples based on a comparison of the test sample description vector with one or more description vectors for the target music samples.

9. The method for understanding music of claim 6, comprising predicting at least one of sales, style, genre, and marketing classification from the test sample description vector.

10. The method for understanding music of claim 6, wherein extracting a plurality of salient terms further comprises downloading a predetermined number of text pages relating to each music sample extracting terms from each downloaded text page computing the salience of each extracted term selecting the plurality of salient terms, where each salient term has a salience greater than a predetermined threshold constructing a truth vector for each term of the plurality of salient terms.

11. The method for understanding music of claim 10, wherein computing the salience of each extracted term further comprises computing a term frequency-inverse document frequency for each extracted term.

12. The method for understanding music of claim 10, wherein computing the salience of each extracted term further comprises computing a Gaussian-weighted term frequency for each extracted term.

13. The method for understanding music of claim 10, wherein constructing a truth vector for each of the plurality of salient terms further comprises constructing an l-element vector $y_t$, wherein l is the number of music samples in the first plurality of music samples each element $y_t(i)$ of vector $y_t$ is indicative of the relevance of term t to the i'th music sample.

14. A non-transitory storage medium having instructions stored thereon which when executed by a processor will cause the processor to perform actions comprising:

training a plurality of classifier machines using a first plurality of music samples, each classifier machine trained for a corresponding one of a plurality of terms testing the classifier machines using a second plurality of music samples using the results of testing the classifier machines to select semantic basis functions from the plurality of terms training a semantic basis classifier machine for each of the selected semantic basis functions, each of the semantic basis classifier machines training using a third plurality of music samples larger than the first plurality of music samples wherein training each semantic basis classifier machine further comprises:

dividing the third plurality of music samples into g groups, where g is an integer greater than one training g sets of semantic basis sub-classifier machines, each set of semantic basis sub-classifier machines trained using a corresponding group of the g groups of music vectors.

15. The storage medium of claim 14, the actions performed further comprising obtaining a test music sample using the semantic basis classifier machines to compute a test sample description vector for the test music sample.

16. The storage medium of claim 15, the actions performed further comprising comparing the test sample description vector with a description provided by a user recommending or not recommending the test music sample to the user depending on the results of the comparison.

17. The storage medium of claim 15, the actions performed further comprising comparing the test sample description vector with one or more description vectors for target music samples determining the test music sample to be similar or not similar to the targets music samples depending on the results of the comparison.

18. The storage medium of claim 15, the actions performed further comprising predicting sales, style, genre, or marketing classification from the test sample description vector.

19. A computing device to understand music, the computing device comprising:

a processor a memory coupled with the processor a non-transitory storage medium having instructions stored thereon which when executed cause the computing device to perform actions comprising training a plurality of classifier machines using a first plurality of music samples, each classifier machine trained for a corresponding one of a plurality of terms testing the classifier machines using a second plurality of music samples using the results of testing the classifier machines to select semantic basis functions from the plurality of terms training a semantic basis classifier machine for each of the selected semantic basis functions, each of the semantic basis classifier machines trained using a third plurality of music samples larger than the first plurality of music samples wherein training each semantic basis classifier machine further comprises:

dividing the third plurality of music samples into g groups, where g is an integer greater than one training g sets of semantic basis sub-classifier machines, each set of semantic basis sub-classifier machines trained using a corresponding group of the g groups of music vectors.

20. The computing device to understand music of claim 19, the actions performed further comprising obtaining a test music sample using the semantic basis classifier machines to compute a test sample description vector for the test music sample.

21. The computing device to understand music of claim 20, the actions performed further comprising comparing the test sample description vector with a description provided by a user recommending or not recommending the test music sample to the user depending on the results of the comparison.

22. The computing device to understand music of claim 20, the actions performed further comprising comparing the test sample description vector with one or more description vectors for target music samples determining the test music sample to be similar or not similar to the target music samples depending on the results of the comparison.

23. The computing device to understand music of claim 20, the actions performed further comprising predicting sales, style, genre, or marketing classification from the test sample description vector.

* * * * *